US005899822A

United States Patent [19]

Yamagishi et al.

[11] Patent Number: 5,899,822

[45] Date of Patent: May 4, 1999

[54] THREE-PIECE SOLID GOLF BALL

[75] Inventors: Hisashi Yamagishi; Hiroshi Higuchi; Junji Hayashi, all of Chichibu; Nobuhiko Matsumura; Kunitoshi Ishihara, both of Izumiohtsu, all of Japan

[73] Assignee: Bridgestone Sports Co., Ltd., Tokyo, Japan

[21] Appl. No.: 08/976,090

[22] Filed: Nov. 21, 1997

[30] Foreign Application Priority Data

Nov. 25, 1996 [JP] Japan ..... 8-329231

[51] Int. Cl.[6] ..... A63B 37/06; A63B 37/12

[52] U.S. Cl. ..... 473/374; 473/378

[58] Field of Search ..... 473/373, 374, 473/376

[56] References Cited

U.S. PATENT DOCUMENTS

| | | | |
|---|---|---|---|
| 4,714,253 | 12/1987 | Nakahara et al. | 473/374 X |
| 5,730,664 | 3/1998 | Asakura et al. | 473/374 X |
| 5,733,205 | 3/1998 | Higuchi et al. | 473/373 X |

FOREIGN PATENT DOCUMENTS

| | | |
|---|---|---|
| 58-92372 | 6/1983 | Japan . |
| 5-4110 | 1/1993 | Japan . |
| 6-319830 | 11/1994 | Japan . |
| 6-343718 | 12/1994 | Japan . |
| 7-24085 | 1/1995 | Japan . |
| 7-194735 | 8/1995 | Japan . |
| 7-194736 | 8/1995 | Japan . |

*Primary Examiner*—George J. Marlo

*Attorney, Agent, or Firm*—Sughrue, Mion, Zinn, Macpeak & Seas, PLLC

[57] ABSTRACT

In a three-piece solid golf ball of the three layer structure consisting of a solid core, an intermediate layer, and a cover, the solid core has a distortion of at least 2.5 mm under a load of 100 kg. The Shore D hardness of the intermediate layer is at least 13 degrees higher than the Shore D hardness of the cover. The ball as a whole has an inertia moment of at least 83 g-cm$^2$. The desirable properties of spin, feel, control and rolling are obtained.

14 Claims, 1 Drawing Sheet

THREE-PIECE SOLID GOLF BALL

BACKGROUND OF THE INVENTION

1. Field of the Invention

This invention relates to a three-piece solid golf ball of the three layer structure consisting of a solid core, an intermediate layer, and a cover. The invention provides a golf ball having the desirable properties of spin, feel, control and distance.

2. Prior Art

Golf balls which have been commercially available for decades include solid golf balls having a solid core enclosed with a cover of synthetic rubber and wound golf balls having a wound core (obtained by winding thread rubber around a liquid center) enclosed with a cover of natural rubber, typically balata rubber and synthetic rubber. While solid golf balls having a cover of synthetic rubber featuring added distance and durability enjoy widespread use, many professional golfers still favor a wound golf ball having a cover of balata rubber, which is simply referred to as wound balata ball, hereinafter.

The reason is that the wound balata ball has superior hitting feel and spin control to the remaining golf balls. Although professional golfers seek a golf ball offering a longer flight distance, they seldom consider distance as the first condition for ball selection, but place more stress on hitting feel and spin control.

In order to produce a golf ball which not only complies with such professional golfers' needs, but is also suited for ordinary golfers' play, various proposals have been made on solid golf balls so as to impart the desirable properties of distance, feel and spin control. For example, JP-B 4110/1993 and JP-A 319830/1994 disclose a two-piece solid golf ball which has a good feel and is improved in control by adjusting spin property. Also proposed were three-piece solid golf balls of the three layer structure consisting of a solid core, an intermediate layer, and a cover as disclosed in JP-A 92372/1983, 24085/1995, 343718/1994, 194735/1995, 194736/1995 and 239068/1997. There were proposed many three-piece solid golf balls which are designed to improve feel and control.

Despite such improvements, many players still use the wound balata ball because the solid golf balls proposed thus far have not reached the feel and spin control levels above which these players are satisfied. In particular, spin control is one of the most important factors for the performance of golf balls. It is thus strongly desired to improve the spin control of solid golf balls without detracting from the remaining properties of distance and feel.

The spin property of solid golf balls can be improved to some extent by making the cover soft. The soft cover, however, lowers the resiliency of the ball, resulting in a reduced flight distance. That is, the superior flight performance characteristic of solid golf balls is lost.

In general, golf clubs used for distance shots such as a driver and long irons have a small loft angle whereas golf clubs used for aiming at the pin or a target such as short irons have a large loft angle and are designed to stop the ball at the desired position rather than distance. When a golf ball is hit with a golf club, the ball receives both a force acting perpendicular to the club face and a force acting parallel to the club face depending on the loft angle. The perpendicular force contributes to deriving resiliency from the ball whereas the parallel force contributes to spinning the ball. On shots with driver and long iron clubs having a small loft angle, the perpendicular force becomes greater while the parallel force is relatively weak. These clubs are designed for distance by imparting an appropriately suppressed spin rate, a relatively low trajectory, and greater resiliency. Inversely, on shots with short iron clubs having a large loft angle, the parallel force becomes greater while the perpendicular force is relatively weak. These clubs are designed to give a greater spin to the ball rather than distance.

Therefore, simply increasing a spin rate is not sufficient. It is desired that upon shots with driver and long iron clubs, a flight distance is ensured by an appropriately suppressed spin rate which restrains flight distance shortage and wind influence which are otherwise caused by the lofting of the ball by spin (to follow a higher trajectory than necessary). Upon shots with short iron clubs for aiming at the target, the ease of control is ensured by a sufficient spin rate leading to a relatively high trajectory and a reduced run or roll after the ball lands. Sufficient in-flight retention of the spin rate given by a strike is also important for the flight distance to be increased and for the spin control to be effective.

Another problem arises upon putting. Unlike ordinary shots to drive the ball into flight, putting rolls the ball on the green so that the ball may readily change its path by angulation on the green. Since putting directly aims the hole, successful putting improves the score and vice versa. What is desired in this regard is a golf ball which rolls well and goes straight upon putting without being affected by subtle angulation.

SUMMARY OF THE INVENTION

Therefore, an object of the present invention is to provide a novel and improved solid golf ball which receives an appropriate spin from a particular type of club selected and offers a soft feel, easy control, and good rolling without detracting from the flight distance and durability characteristic of solid golf balls.

According to the invention, there is provided a three-piece solid golf ball of the three layer structure consisting of a solid core, an intermediate layer, and a cover. The solid core has a distortion of at least 2.5 mm under a load of 100 kg. The Shore D hardness of the intermediate layer is at least 13 degrees higher than the Shore D hardness of the cover. The ball as a whole has an inertia moment of at least 83 g-cm$^2$. With these requirements met, there is obtained a high performance golf ball which offers a soft feel and receives an appropriate spin from any type of club without detracting from the flight distance and durability characteristic of solid golf balls and hence, is improved in distance, durability, feel, and spin control. In addition, this golf ball has good rolling in that it rolls straight upon putting without being affected by subtle angulation on the green.

More particularly, the golf ball of the invention is improved in spin control by using a soft cover. The hard intermediate layer is more than to compensate for a resiliency loss of the soft cover, achieving satisfactory resiliency as a whole. Since the solid core is formed soft as expressed by a distortion of at least 2.5 mm under a load of 100 kg, the soft structure of the soft core combined with the soft cover is effective for appropriately suppressing spin rate upon hitting with driver and long iron clubs having a small loft angle, so that the ball may not be highly lofted, but follows an appropriate flat trajectory without being affected by the wind. The flat trajectory combined with the above-mentioned good resiliency results in a satisfactory flight distance. Furthermore, since the golf ball of the invention has a relatively great inertia moment of at least 83 g-cm$^2$, the ball can retain the spin in flight. Upon driver and long iron shots, the spin rate is not so reduced until the ball nearly lands, and the trajectory is thus extended even at the last stage, resulting in an increased flight distance. Upon short iron shots, spin control is fully exerted in that the run after landing is reduced, and rolling property is good in that the ball will roll straight without being affected by subtle angulation on the green.

BRIEF DESCRIPTION OF THE DRAWINGS

These and other objects, features and advantages of the present invention will be apparent with reference to the following description and drawings.

The sole figure.

DETAILED DESCRIPTION OF THE INVENTION

Figure 1:
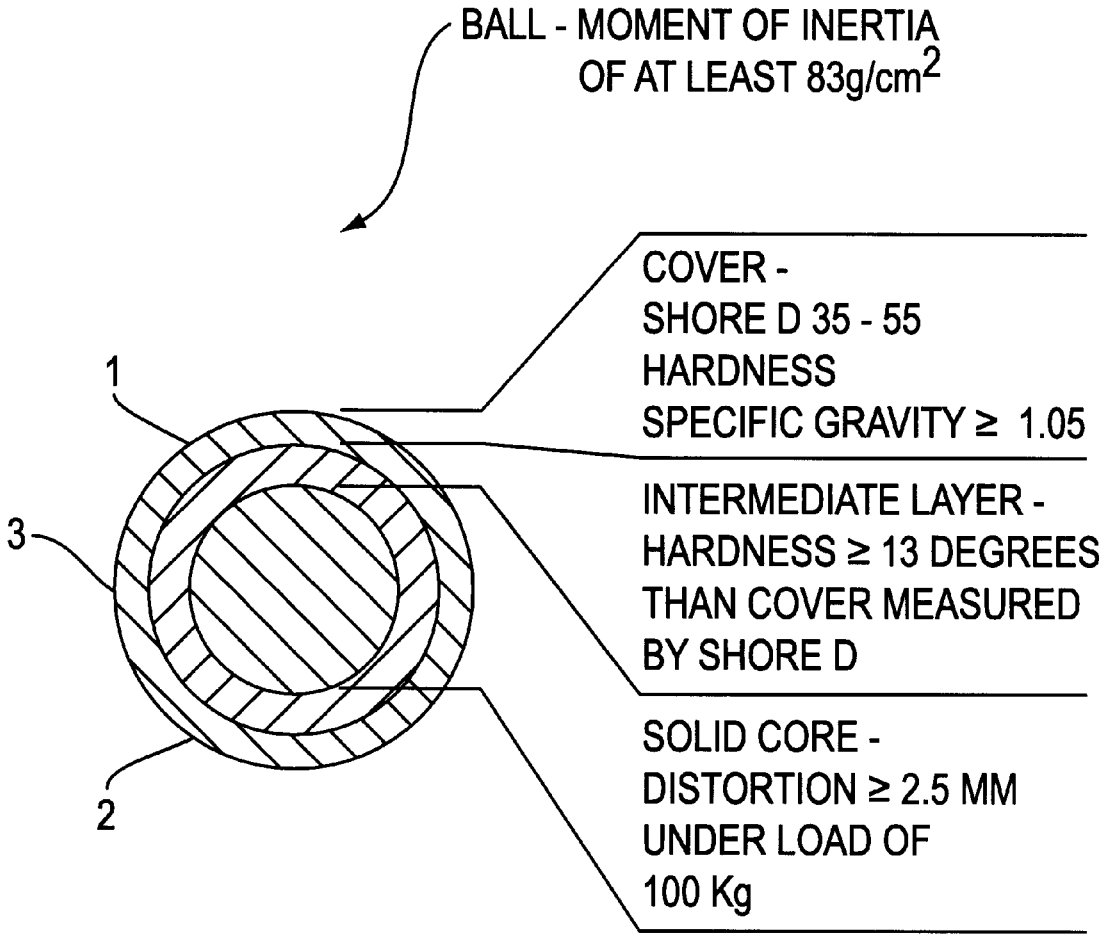
FIG. 1 is a schematic cross-sectional view of a three-piece solid golf ball according to one embodiment of the invention.

Referring to FIG. 1, a three-piece solid golf ball according to the invention is illustrated as comprising a solid core 1, an intermediate layer 2, and a cover 3 disposed in a concentric fashion.

The solid core 1 constituting the center of the golf ball is formed to a hardness expressed by a distortion of at least 2.5 mm, especially at least 2.8 mm under a load of 100 kg. With a distortion of less than 2.5 mm under a load of 100 kg, the ball would receive more spin to loft higher upon driver and long iron shots and give a hard feel upon such shots.

Typically, the solid core 1 has a diameter of 33 to 38 mm, especially 34 to 37 mm though not limited thereto. A diameter of less than 33 mm would lead to a shortage of resiliency whereas a diameter of more than 38 mm would require the intermediate layer 2 and the cover 3 to be thin, inviting the inconvenience of poor durability.

The solid core may be formed of a well-known rubber composition comprising a base rubber, a co-crosslinking agent, and a peroxide by well known methods, for example, molding it at elevated temperature under pressure. The base rubber used herein may be polybutadiene rubber or a mixture of polybutadiene rubber and polyisoprene rubber, which are commonly used in conventional solid golf balls. The use of 1,4-polybutadiene rubber having at least 90% of a cis structure is preferred for the high restitution purpose. The co-crosslinking agent used herein may be selected from conventional ones, for example, zinc and magnesium salts of unsaturated fatty acids such as methacrylic acid and acrylic acid and esters of unsaturated fatty acids such as trimethylpropane trimethacrylate, which are used in conventional solid golf balls. Zinc acrylate is especially preferred for the high restitution purpose. The co-crosslinking agent is preferably used in an amount of about 15 to 35 parts by weight per 100 parts by weight of the base rubber. Many peroxides are useful although dicumyl peroxide or a mixture of dicumyl peroxide and 1,1-bis(t-butylperoxy)-3,3,5-trimethylcyclohexane is preferred. The peroxide is preferably blended in an amount of about 0.5 to 1 part by weight per 100 parts by weight of the base rubber. In the rubber composition, there may be blended other conventional additives such as antioxidants and fillers for adjusting specific gravity, e.g., zinc oxide and barium sulfate, if desired.

The intermediate layer 2 is formed to a Shore D hardness which is at least 13 degrees higher than the Shore D hardness of the cover 3. Preferably the intermediate layer has a Shore D hardness of 60 to 70, more preferably 61 to 68, which is 13 to 40 degrees, especially 13 to 30 degrees higher than the Shore D hardness of the cover, though the invention is not limited thereto. The intermediate layer 2 is formed as a relatively hard layer in order to compensate for a resiliency loss of the soft cover 3. If the intermediate layer has a too low Shore D hardness, the ball would become less resilient and travel a shorter distance.

The intermediate layer 2 preferably has a gage of 1.4 to 4 mm, especially 1.3 to 2.6 mm though not limited thereto.

Since the intermediate layer 2 plays the role of compensating for a resiliency loss of the soft cover 3 as mentioned above, it is formed of a relatively hard, resilient material. Though not critical, useful materials are ionomer resins such as Himilan 1706 and 1605 (Mitsui duPont Polychemical K.K.) and Surlyn (E. I. duPont de Nemours Co.). Preferably, Himilan 1706 and Himilan 1605 are used alone or as a 1/1 mixture. In the intermediate layer, an inorganic filler such as zinc oxide and barium sulfate may be added as a weight adjusting agent to the ionomer resin for adjusting the specific gravity. Additives such as titanium dioxide pigment may also be added.

The cover 3 has a Shore D hardness which is at least 13 degrees lower than the Shore D hardness of the intermediate layer 2. Preferably the cover has a Shore D hardness of 35 to 55, more preferably 37 to 53, which is 13 to 40 degrees, especially 13 to 30 degrees lower than the Shore D hardness of the intermediate layer, although the invention is not limited thereto. The cover 3 is formed as a relatively soft layer in order to improve spin property. If the cover has a too high Shore D hardness, the spin property would be deteriorated, that is, spin control be lost. With a hardness difference of less than 13 degrees between the cover and the intermediate layer, both spin property and resiliency would not be readily satisfied.

The cover 3 preferably has a gage of 1 to 3 mm, especially 1.3 to 2.5 mm though not limited thereto.

The cover 3 may be formed of well-known materials. The base component may be selected from ionomer resins, thermoplastic polyurethane elastomers, polyester elastomers, and polyamide elastomers alone or in admixture with a urethane resin, ethylene-vinyl acetate copolymer, or the like. In the practice of the invention, thermoplastic polyurethane elastomers are preferred because they are soft and scuff resistant. It is especially preferred to use thermoplastic polyurethane elastomers alone. Such a thermoplastic polyurethane elastomer is commercially available under the trade name of Pandex by Dai-Nihon Ink Chemical Industry K.K., for example.

No particular limit is imposed on the specific gravity of the solid core 1, the intermediate layer 2, and the cover 3 constituting the golf ball of the invention. In the practice of the invention, the specific gravity of the intermediate layer is preferably lower than the specific gravity of the solid core and the cover. Illustratively and preferably, the solid core has a specific gravity of 1.1 to 1.3, especially 1.11 to 1.27, the intermediate layer has a specific gravity of 0.93 to 1, especially 0.95 to 0.99, and the cover has a specific gravity of 1.05 to 1.3, especially 1.1 to 1.25, though not limited thereto.

The three-piece solid golf ball of the three layer structure consisting of a solid core, an intermediate layer, and a cover as defined above is adjusted to an inertia moment of at least 83 g-cm$^2$ as a whole.

The optimum range of inertia moment varies with cover hardness. The inertia moment should be greater for a harder cover, but need not be so great for a softer cover. This is because a soft cover is susceptible to spin due to the increased friction upon impact and inversely, a hard cover is unsusceptible to spin due to the reduced friction upon impact. A ball with a hard cover is launched at a low spin rate, which means that the spin would quickly attenuate and the ball stall on fall if the inertia moment is less. Inversely, a ball with a soft cover is launched at a high spin rate, which means that the spin would attenuate slowly and the ball loft higher due to more than necessity spin in flight if the inertia moment is great. Either case has a tendency of reducing the flight distance.

Accordingly, the golf ball of the invention, which is constructed such that the soft structure of the soft core combined with the soft cover may appropriately suppress a spin rate upon hitting with driver and long iron clubs, should have a greater inertia moment in order that the ball retain the spin in flight so that an appropriate spin rate may be maintained until nearly landing and the trajectory be extended even at the last stage, resulting in an increased flight distance. Specifically, the golf ball has an inertia moment of at least 83 g-cm$^2$, preferably 83.5 to 85.5 g-cm$^2$, more preferably 84 to 85.3 g-cm$^2$. With an inertia moment of less than 83 g-cm$^2$, the flight distance is short because of insufficient spin retention and a non-extending trajectory.

The increased inertia moment has the additional advantage of improving the ball rolling on the green upon putting. The ball will roll straight without being affected by subtle angulation on the green.

The inertia moment can be measured by a well-known method. More particularly, the inertia moment is determined by measuring a characteristic frequency X by means of a inertia moment meter by Inertia Dynamics Inc. and substituting the measurement X in the following equation (1).

$$M = \frac{AX(B^2 - C^2)}{(D^2 - E^2)} \quad (1)$$

M: inertia moment

A: constant 1.12

B: characteristic frequency of the ball

C: characteristic frequency of a jig only

D: characteristic frequency of a calibration weight

E: characteristic frequency under no load

The golf ball of the invention wherein the hardness of the solid core, intermediate layer and cover is adjusted optimum and the inertia moment of the ball consisting of these three layers is adjusted optimum has the following advantages. Upon being used with a driver or long iron, good resiliency, a non-lofting trajectory due to an appropriately suppressed spin rate, and a long-lasting trajectory due to good spin retention ensure an increased flight distance. Upon being used with a short iron or pitching wedge, the ball is very controllable in that it stops as desired due to spin property. This permits the player to aim directly at the pin. Upon putting on the green, good rolling property ensures that the ball rolls straight without being affected by angulation. Upon any shot and putting, a soft pleasant feel is obtained. The player can take advantage of the ball at any situation in a round.

As is usually the case, the golf ball of the invention is formed with a plurality of dimples in its surface. The arrangement of dimples may be selected from regular octahedral, dodecahedral, and icosahedral arrangements as in conventional golf balls though not critical. Furthermore, the pattern formed by thus arranged dimples may be any of square, hexagon, pentagon, and triangle patterns. The total number of dimples is preferably 360 to 450, more preferably 372 to 432. There may be two or more types of dimples which are different in diameter and/or depth. It is preferred that the dimples have a diameter of 2.2 to 4.3 mm and a depth of 0.1 to 0.24 mm.

While the three-piece solid golf ball of the invention is constructed as mentioned above, ball specifications including weight and diameter are properly determined in accordance with the Rules of Golf. Also the preparation method is not critical. The respective layers including the solid core 1, intermediate layer 2, and cover 3 may be formed by well-known methods, for example, compression molding and injection molding.

Since the relationship of hardness among the solid core, intermediate layer, and cover is optimized and the inertia moment of the ball as a whole is optimized, the three-piece solid golf ball of the invention offers improved spin property and the ease of control upon approach shots with a short iron without reducing the flight distance upon full shots with a driver or long iron. Also, the ball exhibits good rolling property on the green, that is, straight run. Additionally, the ball is fully durable in that it is not readily scuffed or scraped by shots.

EXAMPLE

Examples of the present invention are given below together with Comparative Examples by way of illustration and not by way of limitation.

Examples 1–5 and Comparative Examples 1–3

Three-piece solid golf balls (Examples 1–5 and Comparative Examples 1–2) were produced by milling a rubber composition of the formulation shown in Table 1, molding and vulcanizing the composition to form a solid core having the specifications shown in Table 3. Using compositions of the formulation shown in Table 2, an intermediate layer and a cover having the specifications shown in Table 3 were successively injection molded around the solid core. A commercially available wound balata ball "The Rextar" by Bridgestone Sports Co., Ltd. was used as the wound golf ball of Comparative Example 3.

It is noted that the amounts of components in the core, intermediate layer, and cover as reported in Tables 1 and 2 are all parts by weight.

The golf balls were examined for inertia moment, flight performance, spin, feel, durability and rolling on the green by the following tests. The results are shown in Table 3.

Inertia moment

The inertia moment is determined by measuring a characteristic frequency X by means of a inertia moment meter by Inertia Dynamics Inc. and substituting the measurement X in the following equation (1).

$$M = \frac{AX(B^2 - C^2)}{(D^2 - E^2)} \quad (1)$$

M: inertia moment

A: constant 1.12

B: characteristic frequency of the ball

C: characteristic frequency of a jig only

D: characteristic frequency of a calibration weight

E: characteristic frequency under no load

Flight Performance

Using a swing robot manufactured by True Temper Co., the ball was hit with a driver (#W1) at a head speed of 50 m/sec. (HS50) to measure a spin rate, carry and total distance.

Spin rate

Using the same swing robot as above, the ball was hit with a sand wedge (#SW) at a head speed of 25 m/sec. (HS25) to measure a spin rate and run.

Hitting feel

Three professional golfers actually hit the ball at a head speed of about 45 m/sec. (HS45) with a driver (#W1) and at a head speed of about 5 m/sec. (HS5) with a putter (#PT) to examine the ball for hitting feel according to the following criteria.

O: very soft feel

Δ: average

X: hard feel

Scuff resistance

Using the same swing robot as above, the ball was hit with a pitching wedge (#PW) at a head speed of 33 m/sec. (HS33). The ball at the hit point was visually observed how it was damaged.

O: no or substantially unperceivable flaw

X: perceivable flaw

Rolling

On the green, three professional golfers actually putted the ball with a putter (#PT). The ball was examined for rolling according to the following criterion.

O: straight and long-lasting rolling

X: not straight and not long-lasting

TABLE 1

| Core No. | 1 | 2 | 3 | 4 | 5 | 6 | 7 |
|---|---|---|---|---|---|---|---|
| Composition (pbw) | | | | | | | |
| Cis-1,4-polybutadiene | 100 | 100 | 100 | 100 | 100 | 100 | 100 |
| Zinc acrylate | 29 | 27 | 29.5 | 25 | 23 | 34 | 35 |
| Zinc oxide | 5 | 5 | 5 | 5 | 5 | 5 | 5 |
| Barium sulfate | 11.3 | 12.2 | 11.1 | 13.1 | 16.6 | 19.5 | 25.3 |
| Antioxidant | 0.2 | 0.2 | 0.2 | 0.2 | 0.2 | 0.2 | 0.2 |
| Dicumyl peroxide | 0.9 | 0.9 | 0.9 | 0.9 | 0.9 | 0.9 | 0.9 |
| Vulcanizing conditions | | | | | | | |
| Temperature (°C.) | 160 | 160 | 160 | 160 | 160 | 160 | 160 |
| Time (min.) | 20 | 20 | 20 | 20 | 20 | 20 | 20 |

TABLE 2

| | A | B | C | D | E | F | G |
|---|---|---|---|---|---|---|---|
| Resin components (pbw) | | | | | | | |
| Pandex T-7890 | — | — | — | 100 | — | — | — |
| Pandex EX7895 | — | — | 100 | — | — | — | — |
| Pandex T-7298 | — | — | — | — | 100 | — | — |
| Himilan 1557 | — | — | — | — | — | 30 | 50 |
| Himilan 1706 | 50 | — | — | — | — | — | — |
| Himilan 1705 | — | 50 | — | — | — | — | — |
| Himilan 1601 | — | — | — | — | — | — | 50 |
| Himilan 1605 | 50 | 50 | — | — | — | — | — |
| Surlyn 8120 | — | — | — | — | — | 50 | — |
| Surlyn 9320 | — | — | — | — | — | 20 | — |
| Additives (g per 100 of resin) | | | | | | | |
| Titanium dioxide | 5.13 | 5.13 | 5.13 | 5.13 | 5.13 | 5.13 | 5.13 |
| Magnesium stearate | 1.22 | 1.22 | 1.22 | 1.22 | 1.22 | 1.22 | 1.22 |
| Ultramarine | 0.33 | 0.33 | 0.33 | 0.33 | 0.33 | 0.33 | 0.33 |

Note:

Pandex is a trade name of thermoplastic polyurethane elastomer by Dai-Nihon Ink Chemical Industry K.K.

Himilan is a trade name of ionomer resin by Mitsui duPont Polychemical K.K.

Surlyn is a trade name of ionomer resin by E. I. duPont de Nemours Co.

TABLE 3

| | Example | | | | | Comparative Example | | |
|---|---|---|---|---|---|---|---|---|
| | 1 | 2 | 3 | 4 | 5 | 1 | 2 | 3 |
| Core | | | | | | | | |
| No. | 1 | 2 | 3 | 4 | 5 | 6 | 7 | commercial wound balata ball*4 |
| Weight (g) | 26.83 | 26.83 | 26.83 | 29.18 | 27.20 | 30.70 | 27.84 | |
| Diameter (mm) | 35.5 | 35.5 | 35.5 | 36.5 | 35.5 | 36.5 | 35.0 | |
| Hardness*1 (mm) | 3.30 | 3.80 | 3.20 | 4.20 | 4.60 | 2.40 | 2.20 | |
| Specific gravity | 1.145 | 1.145 | 1.145 | 1.146 | 1.161 | 1.206 | 1.240 | |
| Intermediate layer | | | | | | | | |
| Material | A | A | A | B | A | A | A | |
| Material hardness*2 | 65 | 65 | 65 | 63 | 65 | 65 | 65 | |
| Weight (g) | 33.66 | 33.66 | 33.66 | 36.26 | 36.26 | 37.78 | 35.62 | |
| Diameter*3 (mm) | 38.75 | 38.75 | 38.75 | 39.7 | 39.7 | 39.7 | 38.75 | |
| Specific gravity | 0.97 | 0.97 | 0.97 | 0.97 | 0.97 | 0.97 | 0.97 | |
| Gage (mm) | 1.63 | 1.63 | 1.63 | 1.60 | 2.10 | 1.60 | 1.88 | |
| Cover | | | | | | | | |
| Material | C | D | E | C | C | F | G | |
| Material hardness*2 | 46 | 40 | 50 | 46 | 46 | 48 | 60 | |
| Specific gravity | 1.20 | 1.20 | 1.20 | 1.20 | 1.20 | 0.97 | 0.97 | |
| Gage (mm) | 1.98 | 1.98 | 1.98 | 1.50 | 1.50 | 1.50 | 1.98 | |
| Hardness difference between intermediate layer and cover | 19 | 25 | 15 | 17 | 19 | 17 | 5 | |
| Ball | | | | | | | | |
| Weight (g) | 45.3 | 45.3 | 45.3 | 45.3 | 45.3 | 45.3 | 45.3 | 45.3 |
| Diameter (mm) | 42.7 | 42.7 | 42.7 | 42.7 | 42.7 | 42.7 | 42.7 | 42.7 |
| Inertia moment (g-cm$^2$) | 84.8 | 84.8 | 84.8 | 84.3 | 84.1 | 81.6 | 81.0 | 75.8 |

TABLE 3-continued

| | Example | | | | | Comparative Example | | |
|---|---|---|---|---|---|---|---|---|
| | 1 | 2 | 3 | 4 | 5 | 1 | 2 | 3 |
| #W1/HS50 | | | | | | | | |
| Spin (rpm) | 2830 | 2800 | 2900 | 2750 | 2700 | 2920 | 3000 | 3240 |
| Carry (m) | 235.5 | 235.0 | 236.5 | 237.6 | 237.5 | 234.5 | 235.0 | 232.5 |
| Total (m) | 251.2 | 252.0 | 252.5 | 253.1 | 254.0 | 251.0 | 251.0 | 244.3 |
| #SW/HS25 | | | | | | | | |
| Spin (rpm) | 8300 | 8530 | 7750 | 7950 | 7880 | 7740 | 6970 | 8020 |
| Run (m) | 1.0 | 0.4 | 1.5 | 1.2 | 1.4 | 2.2 | 4.0 | 1.8 |
| Feel | | | | | | | | |
| #W1/HS45 | ○ | ○ | ○ | ○ | ○ | ○ | X | ○ |
| #PT/HS5 | ○ | ○ | ○ | ○ | ○ | ○ | X | ○ |
| Scuff resistance | | | | | | | | |
| #PW/HS33 | ○ | ○ | ○ | ○ | ○ | X | ○ | X |
| Rolling | | | | | | | | |
| #PT | ○ | ○ | ○ | ○ | ○ | X | X | X |

*1a distortion (mm) of a ball under an applied load of 100 kg
*2Shore D hardness
*3a diameter of a sphere consisting of core plus intermediate layer
*4The Rexter by Bridgestone Sports Co., Ltd.

As is evident from Table 3, the golf balls within the scope of the invention are excellent in all the factors of flight distance, spin control, feel, scuff resistance, and rolling. In contrast, the golf ball of Comparative Example 1 has insufficient spin property to restrict a run on #W1 shot and poor rolling (non-straight rolling) on the green upon putting, owing to a higher core hardness and a lower inertia moment. It is also susceptible to scuff flaw and less durable. The golf ball of Comparative Example 2 shows poor spin property owing to a harder cover, a smaller hardness difference between the intermediate layer and the cover, and a lower inertia moment. More particularly, a greater spin rate is obtained upon #W1 shot where more spin is unnecessary whereas a less spin rate is obtained upon #SW shot where more spin is necessary. The latter results in an increased run on #SW shot. Also the ball of Comparative Example 2 shows poor rolling (non-straight rolling) on the green upon putting. The wound golf ball of Comparative Example 3 follows a lofting and non-extending trajectory owing to an increased spin rate with #W1 and a low inertia moment, resulting in a shorter distance. It shows poor rolling on the green upon putting. It is also susceptible to scuff flaw and less durable.

Although some preferred embodiments have been described, many modifications and variations may be made thereto in the light of the above teachings. It is therefore to be understood that within the scope of the appended claims, the invention may be practiced otherwise than as specifically described.

We claim:

1. A three-piece solid golf ball of the three layer structure consisting of a solid core, an intermediate layer, and a cover, wherein said solid core has a distortion of at least 2.5 mm under a load of 100 kg, the Shore D hardness of said intermediate layer is at least 13 degrees higher than the Shore D hardness of said cover, and the ball as a whole has an inertia moment of at least 83 g-cm$^2$.

2. The three-piece solid golf ball of claim 1 wherein said intermediate layer has a Shore D hardness of 60 to 70.

3. The three-piece solid golf ball of claim 1 wherein said cover has a Shore D hardness of 35 to 55.

4. The three-piece solid golf ball of claim 1 wherein said cover is mainly formed of a thermoplastic polyurethane elastomer.

5. The three-piece solid golf ball of claim 1 wherein the specific gravity of said intermediate layer is lower than the specific gravity of said solid core and said cover.

6. The three-piece solid golf ball of claim 1 wherein said cover has a specific gravity of at least 1.05.

7. The three-piece solid golf ball of claim 1, wherein the inertia amount is in a range of 83.5 to 85.5 g-cm$^2$.

8. The three-piece of solid golf all of claim 1, wherein the inertia moment is in a range of 84 to 85.3 g-cm$^2$.

9. The three-piece solid golf ball of claim 1, wherein said solid core has a specific gravity in the range of 1.1 to 1.3.

10. The three-piece solid golf ball of claim 1, wherein said intermediate layer has a specific gravity in the range of 0.93 to 1.0.

11. The three-piece solid golf ball of claim 1, wherein said cover has a specific gravity in the range of 1.05 to 1.3.

12. The three-piece solid golf ball of claim 1, wherein said solid core has a diameter in the range of 33 to 38 mm.

13. The three-piece solid golf ball of claim 1, wherein said intermediate layer has a thickness in the range of 1.4 to 4.0 mm.

14. The three-piece solid golf ball of claim 1, wherein said cover has a thickness in the range of 1 to 3 mm.

* * * * *